US012800248B2

(12) United States Patent
Hummel et al.

(10) Patent No.: US 12,800,248 B2
(45) Date of Patent: Nov. 17, 2026

(54) BREECH ASSEMBLY FOR A GUN AND METHOD FOR CHECKING THE FLUID LEVEL IN THE RECOIL DAMPING SYSTEM OF SUCH A BREECH ASSEMBLY

(71) Applicant: KNDS FRANCE, Versailles (FR)

(72) Inventors: Boris Hummel, Bourges (FR); Frédéric Hubschwerlen, Bourges (FR); Patrick Balbo, Bourges (FR); Pascal Sabourin, Bourges (FR); Antoine Latroye, Bourges (FR)

(73) Assignee: KNDS FRANCE, Versailles (FR)

( * ) Notice: Subject to any disclaimer, the term of this patent is extended or adjusted under 35 U.S.C. 154(b) by 0 days.

(21) Appl. No.: 19/233,167

(22) Filed: Jun. 10, 2025

(65) Prior Publication Data

US 2025/0383169 A1 Dec. 18, 2025

(30) Foreign Application Priority Data

Jun. 12, 2024 (FR) ..... 2406156

(51) Int. Cl.
*F41A 3/90* (2006.01)

(52) U.S. Cl.
CPC ..... *F41A 3/90* (2013.01)

(58) Field of Classification Search
CPC ..... F41A 3/90; F41A 25/02
See application file for complete search history.

(56) References Cited

U.S. PATENT DOCUMENTS

| | | | | |
|---|---|---|---|---|
| 1,318,605 A | | 10/1919 | Schneider | |
| 2,638,339 A | * | 5/1953 | Taylor | F41A 25/02 89/44.01 |
| 4,875,402 A | * | 10/1989 | Metz | F41A 25/02 89/43.01 |
| 8,056,464 B2 | * | 11/2011 | Cazalieres | F41A 25/20 89/43.01 |
| 2009/0126558 A1 | * | 5/2009 | Kohnen | F41A 25/20 89/43.01 |

FOREIGN PATENT DOCUMENTS

| | | | | |
|---|---|---|---|---|
| FR | 516547 A | * | 4/1921 | F41A 25/02 |
| GB | 130049 A | * | 7/1919 | F41A 25/20 |
| WO | WO-2007110140 A1 | * | 10/2007 | F41A 25/20 |

OTHER PUBLICATIONS

Feb. 10, 2025 Search Report and Written Opinion issued in French Patent Application No. 2406156.

* cited by examiner

*Primary Examiner* — Benjamin P Lee
(74) *Attorney, Agent, or Firm* — Oliff PLC

(57) ABSTRACT

A breech assembly including a breech ring, a recoil damping system, a fluid filling valve for the damping system and a level gauge including a fluid level indicator mounted movable in axial translation relative to the breech ring. According to the invention, the breech ring includes an axial inner housing opening out through an opening at the rear face of the breech ring, wherein the recoil damping system, the filling valve and the level gauge are received in the inner housing. The invention also relates to a method for controlling the fluid level in the recoil damping system of such a breech assembly.

15 Claims, 3 Drawing Sheets

[Fig. 1]
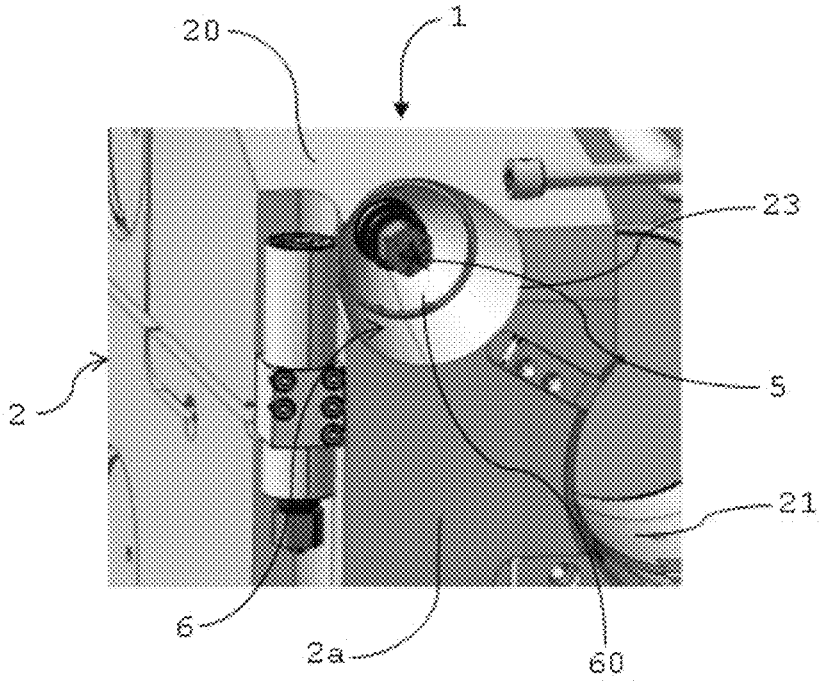
[Fig. 2]
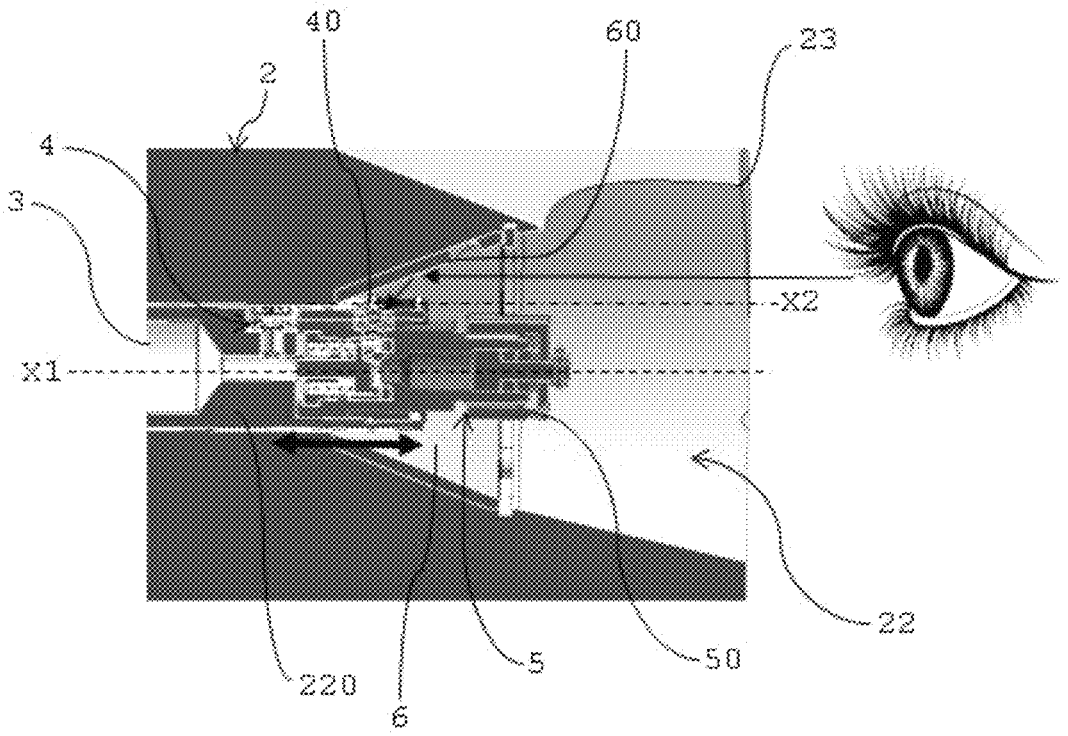

[Fig. 3A]
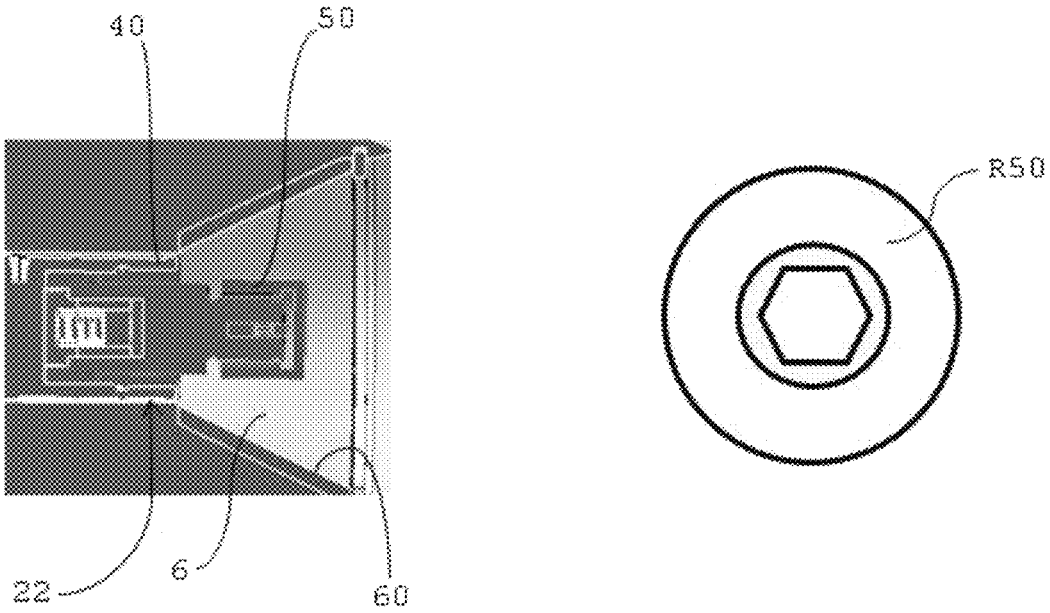
[Fig. 3B]
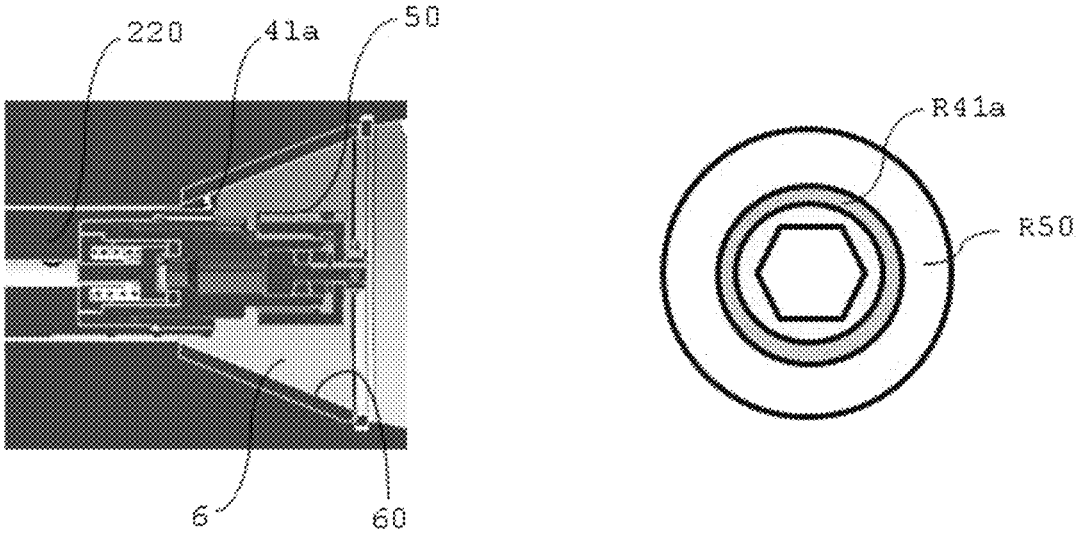

[Fig. 3C]
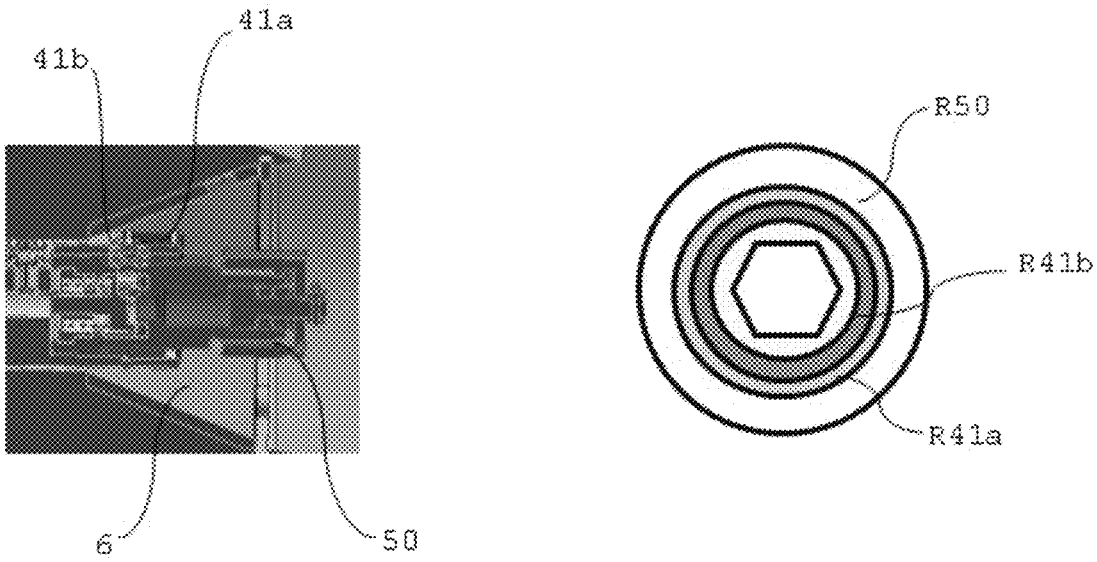
[Fig. 3D]
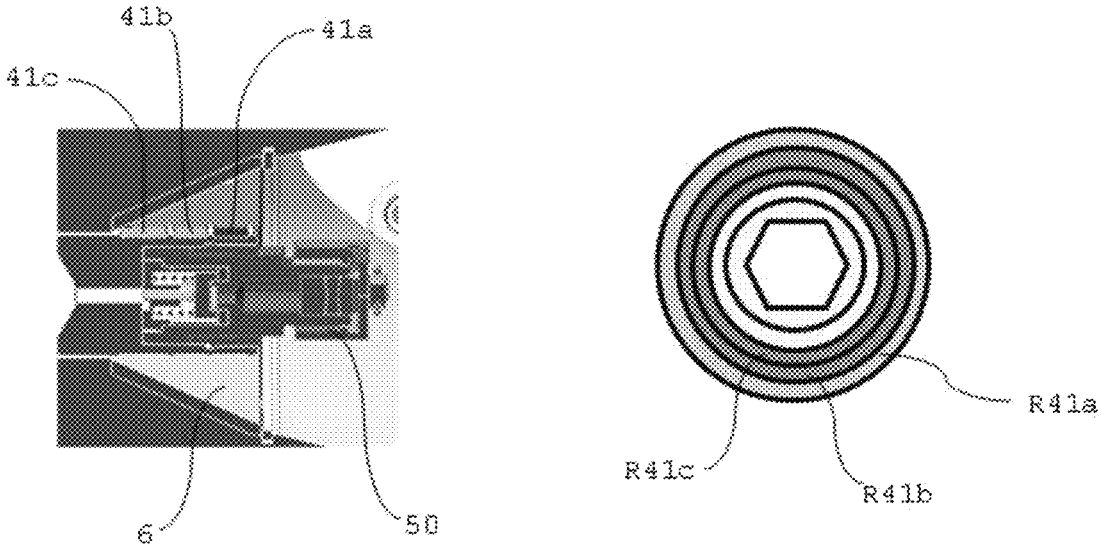

BREECH ASSEMBLY FOR A GUN AND METHOD FOR CHECKING THE FLUID LEVEL IN THE RECOIL DAMPING SYSTEM OF SUCH A BREECH ASSEMBLY

The technical field of the invention is that of artillery guns, particularly large-calibre guns.

The present invention relates in particular to the readiness control of a recoil damping system of such a gun, and relates to a breech assembly for a gun comprising a recoil damping system and a level gauge, as well as a method for controlling the readiness of such a recoil damping system.

On many artillery guns, the cradle is connected to the breech ring by a recoil damping system comprising one or more elastic links, brakes or recuperators, which comprise a body secured to the cradle and a rod sliding in the body and fixed to the breech ring. Controlling the readiness of the damping system consists in checking that the quantity of fluid and/or pressure in the system is nominal.

It is known to carry out this checking operation by visually checking the position of a gauge relative to the end of the damping system. The position of this gauge is generally visualized by means of colored or graduated markers placed along the gauge.

However, to date, visualization of the position of the gauge requires access to the sides of the gun.

The invention aims to provide a way of installing the level gauge in a gun that is integrated into a remotely-operated turret, without any access to the sides of the gun.

The solution relies on enabling the level gauge to be filled and viewed from the rear of the breech ring.

The invention thus relates to a breech assembly for a gun, comprising:

- a breech ring having a rear face;
- a recoil damping system connected to the breech ring;
- a fluid filling valve for the damping system; and
- a level gauge connected to the recoil damping system, the level gauge comprising a fluid level indicator mounted movable in axial translation relative to the breech ring, the fluid level in the recoil damping system being indicated by the axial position of the indicator, characterized in that the breech ring comprises an axial inner housing opening out through an opening at the rear face, the recoil damping system, the filling valve and the level gauge are received in the inner housing, the opening opens into a means for viewing the axial position of the indicator, which is provided in the inner housing and allows the passage of the indicator and the filling valve, the indicator being movable between a sunk position, forward of the viewing means, and a maximum protruding position, in which the indicator protrudes into the viewing means.

With such a breech assembly, filling and viewing of the level gauge takes place from the rear of the breech ring, enabling integration of the gun comprising such a breech assembly into a remotely-operated turret without any access from the sides of the gun. In other words, the present invention makes it possible to adapt the reading of the readiness of a recoil damping system to the readability constraints imposed by a gun whose architecture does not allow access to the sides of the gun.

The recoil damping system can be at least one element such as a brake, a recuperator or an elastic link.

In a particular embodiment, the viewing means is a frustoconical through recess arranged between the opening and a cylindrical portion of the inner housing and coaxial with the longitudinal axis of the cylindrical portion, the opening being a circular opening and the recess having a small-diameter end on the cylindrical portion side and a large-diameter end on the opening side.

Alternatively, the recess could have another flared shape towards its end on the rear face of the breech ring.

Preferably, the recess has a reflective inner surface added to or machined in the mass of the breech ring. Such a reflective surface is capable of reflecting light, like a mirror, and thus of viewing the portion of the indicator and filling valve that extend through the recess.

Advantageously, the inner reflective surface covers an angular range of 360 degrees around the longitudinal axis of the recess.

Alternatively, the inner reflective surface can cover a given angular sector of less than 360 degrees.

Preferably, the recess has a taper angle ranging between 10 and 160 degrees, and more preferably between 30 and 120 degrees.

Preferably, the indicator is in form of an indicator rod comprising graphic elements arranged along said rod, including at least a first graphic element associated with an underfilled recoil damping system, a second graphic element associated with a ready system and a third graphic element associated with an overfilled system.

Advantageously, the graphic elements are colored areas of different colors or spaced from one another.

For example, the colored zones can include a first colored zone in red, a second colored zone in green and a third colored zone in white.

Alternatively, the graphic elements could be patterns or graduations.

Preferably, the filling port of the valve is coaxial with the longitudinal axis of the recess and oriented towards the opening.

Preferably, the opening is located at the upper edge of the rear wall of one of the two side cheeks of the breech ring.

The invention also relates to a method for checking, by an operator, the fluid level in the recoil damping system of a breech assembly as defined above, characterized in that it comprises the following steps:

- the operator positions himself at the opening in the rear face of the breech ring;
- the operator visually detects the indicator of the level gauge using the viewing means, if applicable by reflection on the inner reflective surface; and
- deduce the position of the indicator and therefore the underfilled, ready or overfilled state of the system, using a color code.

Preferably, in the event that it is deduced that the system is underfilled, the method further comprises a step consisting in opening the filling valve and proceeding to fill the system with fluid from the filling port until the ready state is reached.

The invention will be better understood upon reading the following description of the preferred embodiment, a description made in the light of the appended drawings, in which:

FIG. 1 is a partial perspective view of the rear face of a breech ring of the breech assembly according to the invention;

FIG. 2 is a side view, in longitudinal section along the longitudinal axis of the inner housing of the breech assembly, showing the indicator as well as the positioning of the eye for visual control of the indicator;

FIG. 3A shows a side view in longitudinal section at the viewing means, as well as the visual obtained, when the system is underfilled;

FIG. 3B shows another side view in longitudinal section at the viewing means, as well as a visual obtained, when the system is underfilled;

FIG. 3C shows a side view in longitudinal section at the viewing means, as well as a visual obtained, when the system is ready; and FIG. 3D shows a side view in longitudinal section at the viewing means, as well as a visual obtained, when the system is overfilled.

Referring first to FIGS. 1 and 2, it can be seen that the breech assembly 1 according to the present invention is intended to equip a gun whose integration does not allow access to the sides of the gun, but only to the rear of the gun.

Overall, the breech assembly 1 comprises a breech ring 2, a recoil damping system 3, a level gauge 4, a filling valve 5 and a viewing means 6. In the Figures, the representation of the breech assembly 1 has been deliberately limited to the rear part.

In a known manner, the breech ring 2 comprises two cheeks 20, between which a breech wedge 21 is movable. The breech ring 2 comprises an inner housing 22 extending inwards of the breech ring 2, from an opening 23 on the rear face 2*a* of the breech ring 2. This inner housing 22 extends along a longitudinal axis X1 parallel to the longitudinal axis of the gun barrel (not shown). The opening 23 here is provided at the upper edge of one of the two cheeks 20 and at the outer corner of this cheek 20. The opening 23 is an opening with a circular cross-section. The inner housing 22 is dimensioned to slidingly receive the level gauge 4 connected to the damping system 3 and the filling valve 5 of the damping system 3.

The recoil damping system 3 is known per se. This recoil damping system 3 can be at least one element such as a brake, a recuperator or an elastic link.

In a known manner, the level gauge 4 is connected to the recoil damping system 3. The level gauge 4 comprises a fluid level gauge 40 in the form of an indicator rod 40 mounted movable in axial translation relative to the breech ring 2.

In other words, the indicator rod 40 is connected to the damping system 3 and is movably mounted in the inner housing 22 along an axis X2 parallel to the axis X1 of the inner housing 22. More specifically, the indicator rod 40 can be moved in translation, progressively and as a function of the fluid level in the damping system 3, between a sunk position, remote from the opening 23, and a maximum protruding position, close to the opening 23. The direction of translation of the indicator rod 40 is an axial direction that is parallel to the longitudinal axis X1 of the inner housing 22, as shown by the double arrow on FIG. 2. The indicator rod 40 has several marks or colored areas 41*a*, 41*b*, 41*c* arranged along the rod 40, from the free end of the rod 40 on the opening 23 side. In the embodiment shown, the rod 40 has three colored areas 41*a*, 41*b*, 41*c*, for example a red area 41*a* at the free end, followed by two green areas 41*b*, 41*c*, the three colored areas 41*a*, 41*b*, 41*c* being slightly spaced by an uncolored area.

The filling valve 5 is accessible from the rear face 2*a* of the breech ring 2. It is closed by a screw plug 50, which simply has to be unscrewed from the rear to allow filling through the filling port of the valve 5. The plug 50 has a hexagonal cross-section and its longitudinal axis is coaxial with the longitudinal axis X1 of the inner housing 22. Thus, the valve 5 and its plug 50 are mounted movable in axial translation along the longitudinal axis X1 of the inner housing 22.

The viewing means 6 is arranged and configured to allow the indicator rod 40 to be viewed from the rear face 2*a* of the breech ring 2. This viewing means 6 is a flared through recess 6 extending from the opening 23 and communicating with the inner housing 22. The recess 6 is flared towards the opening 23. The central longitudinal axis of the recess 6 is coaxial with the axis of the opening 23 and the axis X1 of the inner housing 22. In the embodiment shown, the recess 6 is a frustoconical recess that opens outwards through the opening 23, on the one hand, and into a cylindrical portion 220 of the inner housing 22, on the other hand. The diameter of the cylindrical portion 220 is smaller than the diameter of the opening 23, so the diameter of the recess 6 at its cylindrical portion 220 end is smaller than its diameter at its opening 23 end, so that the recess 6 has a sufficient taper to allow direct visual access to the indicator rod 40. The frustoconical recess 6 can have several successive frustoconical portions with different taper angles, for example a first frustoconical portion that opens into the cylindrical portion 220 and a second frustoconical portion that opens outwards.

To facilitate viewing of the indicator rod 40, the recess 6 has a reflective inner surface 60. This reflective surface 60 can be due to a surface finish resulting from integral machining of the breech ring 2 or can be a reflective surface added, for example glued, fixed or form-fitted into the recess 6. For example, the reflective surface 60 can be a surface of metallic material with a neat and/or polished surface finish, with or without surface treatment, a surface of polymer material with a metallic surface deposit with a neat and/or polished surface finish, or any other surface capable of reflecting light and producing a mirror effect.

The reflective surface 60 extends over a certain length from the small-diameter end of the recess 6. It can extend from the small-diameter end to the opening 23 or to an area close to the opening 23. Similarly, the reflective surface 60 can cover an angular range of 360 degrees, i.e. the entire side wall of the recess 6, or cover an angular sector of less than 360 degrees. In the case of an angular sector of less than 360 degrees, this angular sector at least partially covers the indicator rod 40.

In use, when one wishes to check the readiness of the damping system 3 of a gun equipped with the breech assembly 1 according to the present invention, it is sufficient to look at the opening 23 in the rear face 2*a* of the breech ring 2, as shown in FIG. 2. The colored area(s) 41*a*, 41*b*, 41*c* of the part of the indicator rod 40 protruding into the recess 6 are reflected, by mirror effect, on the inner reflective surface 60 of the recess 6. These colored areas 41*a*-41*c* can therefore be detected visually by directly observing the reflective surface 60 of the recess 6. Depending on the visual obtained, i.e. the colored pattern formed by the reflection of the colored area(s) 41*a*-41*c*, it is then possible to deduce the position of the indicator rod 40 and therefore the filling level of the damping system 3. Indeed, each visual is a color code associated with a position of the indicator 40, said position being associated with an underfilling, readiness or overfilling of the damping system 3.

In FIG. 3A, the resulting visual (on the right on FIG. 3A) shows the reflection 550 only of the color associated with the filling valve 5. This implies that only the filling valve 5 protrudes into the recess 6 (on the left on FIG. 3A). The indicator rod 40 is located forward of the recess 6, in the cylindrical portion 220 of the inner housing 22, in a position called sunk position. Such a sunk position of the indicator rod 40 corresponds to an underfilled state of the damping system 3. In such a state, firing is prohibited. In this case, the damping system 3 must be completely filled via the filling port, after unscrewing the plug 50, from the rear face 2*a*.

In FIG. 3B, the visual obtained shows the reflection R50 of the color associated with the filling valve 5, as well as the reflection R41*a* of the first colored area 41*a* of the indicator rod 40. This implies that the filling valve 5 and the first colored area 41*a* protrude into the recess 6. The indicator rod 40 has thus moved in axial translation from its sunk position to a first position protruding into the recess 6. Such a first protruding position of the indicator rod 40 also corresponds to an underfilled state of the damping system 3. The color of the first colored area can be red.

In FIG. 3C, the visual obtained shows the reflection R50 of the color associated with the filling valve 5, as well as the reflections R41*a* and R41*b* of the first 41*a* and second 41*b* colored areas of the indicator rod 40. This implies that the filling valve 5, the first colored area 41*a* and the second colored area 41*b* protrude into the recess 6. The indicator rod 40 has thus moved in axial translation from its first protruding position to a second protruding position into the recess 6. Such a second protruding position of the indicator rod 40 corresponds to a ready state of the damping system 3. The color of the second colored area 41*b* can be green. Detection of the ready state can be carried out easily and quickly simply by detecting two colored areas of distinct colors associated with the indicator rod 40. Such a ready state authorizes firing.

In FIG. 3D, the visual obtained shows the reflection R50 of the color associated with the plug 50 of the filling valve 5, as well as the reflections R41*a*, R41*b* and R41*c* of the first 41*a*, second 41*b* and third 41*c* colored areas of the indicator rod 40. This implies that the plug 50 of the filling valve 5, the first colored area 41*a*, the second colored area 41*b* and the third colored area 41*c* protrude into the recess 6. The indicator rod 40 has thus moved axially from its second protruding position to a third protruding position, the so-called maximum protruding position, into the recess 6. Such a maximum protruding position of the indicator rod 40 corresponds to an overfilled state of the damping system 3. The color of the third colored area 41*c* can be green or any other color, such as the color of an unpainted area. Detection of the overfilled state can be carried out easily and quickly simply by detecting three or more colored areas associated with the indicator rod 40. Such an overfilled state prevents firing.

It is understood that the particular embodiments just described are indicative and non-limiting, and that modifications can be made without departing from the present invention.

For example, the color code of the colored areas can be any suitable color code. Similarly, the colored areas along the indicator rod can be replaced by any suitable graphic element suitable for being visually distinguished. With regard to the viewing means, the recess can have any flared shape allowing visual access to the inner surface of the recess, without limitation to a frustoconical shape.

The invention claimed is:

1. A breech assembly for a gun, comprising:

a breech ring having a rear face;

a recoil damping system connected to the breech ring;

a fluid filling valve for the recoil damping system; and a level gauge connected to the recoil damping system, the level gauge comprising a fluid level indicator mounted movable in axial translation relative to the breech ring, a fluid level in the recoil damping system being indicated by an axial position of the indicator, wherein the breech ring comprises an axial inner housing opening out through an opening at the rear face, the recoil damping system, the filling valve and the level gauge are received in the inner housing, the opening opens into a viewing means for viewing the axial position of the indicator, wherein the viewing means is provided in the inner housing and allows the passage of the fluid level indicator and the fluid filling valve, the fluid level indicator being movable between a sunk position, which is forward of the viewing means, and a maximum protruding position, in which the fluid level indicator protrudes into the viewing means.

2. The breech assembly according to claim 1, wherein the viewing means is a frustoconical through recess arranged between the opening and a cylindrical portion of the inner housing, the recess being coaxial with the longitudinal axis X1 of the cylindrical portion, the opening being a circular opening and the recess having a small- diameter end on the cylindrical portion side and a large-diameter end on the opening side.

3. The breech assembly according to claim 2, wherein the recess has a reflective inner surface added to the breech ring.

4. The breech assembly according to claim 2, wherein the recess has a reflective inner surface machined in the mass of the breech ring.

5. The breech assembly according to claim 3, wherein the inner reflective surface covers an angular range of 360 degrees around the longitudinal axis of the recess.

6. The breech assembly according to claim 2, wherein the recess has a taper angle ranging between 10 and 160 degrees.

7. The breech assembly according to claim 6, wherein the recess has a taper angle ranging between 30 and 120 degrees.

8. The breech assembly according to claim 5, wherein the recess has a taper angle ranging between 10 and 160 degrees.

9. The breech assembly according to claim 8, wherein the recess has a taper angle ranging between 30 and 120 degrees.

10. The breech assembly according to claim 1, wherein the fluid level indicator is in the form of an indicator rod comprising graphic elements arranged along said indicator rod, including at least a first graphic element associated with an underfilled recoil damping system, a second graphic element associated with a ready recoil damping system and a third graphic element associated with an overfilled recoil damping system.

11. The breech assembly according to claim 10, wherein the graphic elements are colored areas of different colors.

12. The breech assembly according to claim 10, wherein the graphic elements are colored areas spaced from one another.

13. The breech assembly according to claim 2, wherein a filling port of the fluid filling valve is coaxial with the longitudinal axis of the recess and oriented towards the opening.

14. A method for checking, by an operator, the fluid level in the recoil damping system of a breech assembly according to claim 1, wherein the method comprises the following steps:

the operator positions himself at the opening in the rear face of the breech ring;

the operator visually detects the fluid level indicator of the level gauge using the viewing means; and deduce the position of the fluid level indicator and therefore the underfilled, ready or overfilled state of the recoil damping system, using a color code.

15. The method according to claim 14, wherein, in the event that it is deduced that the recoil damping system is underfilled, the method further comprises a step consisting in opening the fluid filling valve and proceeding to fill the recoil damping system with fluid from a filling port of the fluid filling valve until the ready state is reached.

* * * * *